US006648658B2

(12) United States Patent
Okabe et al.

(10) Patent No.: US 6,648,658 B2
(45) Date of Patent: Nov. 18, 2003

(54) LEVER FITTING TYPE CONNECTOR

(75) Inventors: Toshiaki Okabe, Shizuoka-ken (JP); Tetsuya Yamashita, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/106,506

(22) Filed: Mar. 27, 2002

(65) Prior Publication Data

US 2002/0142479 A1 Oct. 3, 2002

(30) Foreign Application Priority Data

Mar. 28, 2001 (JP) ..... 2001-093692

(51) Int. Cl.[7] ..... H01R 13/62
(52) U.S. Cl. ..... 439/157; 439/160
(58) Field of Search ..... 439/157, 153, 439/160, 372, 310

(56) References Cited

U.S. PATENT DOCUMENTS 4,586,771 A * 5/1986 Kraemer et al. ..... 439/325
5,445,530 A * 8/1995 Inoue et al. ..... 439/157
5,727,959 A * 3/1998 Yagi et al. ..... 439/157
5,915,982 A * 6/1999 Kashiyama et al. ..... 439/157
6,146,161 A * 11/2000 Osawa ..... 439/140
6,193,531 B1 * 2/2001 Ito et al. ..... 439/157
6,254,408 B1 * 7/2001 Hattori et al. ..... 439/157

FOREIGN PATENT DOCUMENTS

JP 4-67582 3/1992

* cited by examiner

*Primary Examiner*—Hien Vu
(74) *Attorney, Agent, or Firm*—Finnegan, Henderson, Farabow, Garrett, & Dunner, L.L.P.

(57) ABSTRACT

A lever fitting type connector (10) has a lever (40) provided with a rotation fulcrum portion (41), an application point portion (42) and an operation portion (43), which is interposed between a first connector (20) and a second connector (30). The rotation fulcrum portion (41) of the lever (40) is pivoted in a rotating manner to the first connector (20). In a state that both of the connectors are separated, an initial mounting position of the lever (40) is arranged substantially in parallel to a width direction of the first connector (20). A positional relation among the rotation fulcrum portion (41), the application point portion (42) and the operation portion (43) is constituted such that a fitting force is generated by an operation force in a drawing direction applied to the operation portion (43). After mutually inserting both of the connectors (20, 30) to a lever operation starting position, the operation force in the drawing direction is applied to the operation portion (43). Accordingly, the connectors (20, 30) are regularly fitting.

4 Claims, 7 Drawing Sheets

LEVER FITTING TYPE CONNECTOR

BACKGROUND OF THE INVENTION

1. Field of the Invention

The present invention relates to a lever fitting type connector structured such as to rotate a lever provided between two connectors fitted to each other, so as to convert a lever operating force into a fitting force between these two connectors.

2. Description of the Related Art

As a lever fitting type connector, there has been proposed a structure shown in FIG. 1 and FIG. 2. As shown in FIG. 1, a lever fitting type connector 1 is generally constituted by a female connector 2 mounted to a side of equipment or the like, a male connector 3 to which a wire harness (not shown) is connected, and a lever 4 interposed between the female and male connectors 2 and 3. A plurality of terminal receiving chambers 3*a* is formed in the male connector 3. A terminal (not shown) connected to a edge of each of electric wires of the wire harness, is received in each of the terminal receiving chambers 3*a*.

As shown in FIG. 1 and FIG. 2, the lever 4 is outward fitted astride both upper and lower side walls of the male connector 3. The lever 4 is pivoted in a rotating manner to a cylindrical boss portion 3*b* protruding from the male connector 3.

In order to connect the female connector 2 to the male connector 3, the male connector 3 is temporarily fitted within the female connector 2 in a state that the lever 4 is mounted to the male connector 3. In this temporarily fitting state, an operation force in a pressing direction is applied to an operation portion 4*a* of the lever 4. Then, the lever 4 rotates around an engagement projection 4*b* engaged with the female connector 2. The engagement projection 4*b* forms a fulcrum. The rotating force is input to the boss portion 3*b*, so as to constitute the operation force. Hence, the male connector 3 is completely pressed within the female connector 2, so that a regularly fitted state is achieved. The operation force of the operation portion 4*a* in the lever 4 can be converted into a fitting force of the male connector 3.

However, in the lever fitting type connector 1 mentioned above, in order to generate the fitting force in the lever 4, the operation force in a pressing direction is applied to the operation portion 4*a*. Hence, it is necessary to secure a pressing amount of the operation portion 4*a* at an initial mounting position of the lever 4, in a state that the female connector 2 and the male connector 3 are separated from each other (refer to FIG. 2). That is, it is necessary that a side of the operation portion 4*a* in the lever 4 protrude a distance L outward from the male connector 3. Since the lever 4 connected to the male connector 3 is protruded, the male connector 3 is wholly made large. Further, the lever fitting type connector 1 can be employed in the case of connecting a plurality of wire harnesses connected to a lot of electrical parts in a vehicle or the like. In the case that the lever fitting type connector 1 is employed for arranging wires in the vehicle, the male connector 3 is made larger. Hence, in order to pass the lever fitting type connector 1 through a gap for arranging the wire harness, it is necessary to make a large space. Accordingly, it is hard to secure the arranging space for the wire harness.

It is necessary to intend to reduce a protruding amount of the lever 4 so as to make a volume compact. However, an amount of rotational operation of the lever 4 becomes necessarily small due to downsizing. Further, a servo assisting effect applied to a application point in the lever 4 is reduced, and a sufficient fitting force can not be obtained.

The lever 4 is engaged with the boss portion 3*b*, and is integrally formed with the male connector 3. Further, after the female connector 2 and the male connector 3 are completely fitted, the lever 4 is left in a state of being mounted between the female connector 2 and the male connector 3. Since the lever 4 is of no use for the female connector 2 and the male connector 3 completely fitted, and is left in the lever fitting type connector 1, a useless part is generated and an increase of weight of the lever fitting type connector 1 is caused.

SUMMARY OF THE INVENTION

An object of the present invention is to intend to make a connector compact while sufficiently securing an amount of rotational operation of a lever. Another object of the present invention is to take out the lever, which becomes of no use after a complete fitting.

The first aspect of the present invention provides a lever fitting type connector comprising: a first connector; a second connector fitted to the first connector; and a lever interposed between the first connector and the second connector, having a rotation fulcrum portion, an application point portion and an operation portion, and converting an operation force applied to the operation portion into a fitting force between the first connector and the second connector, wherein the rotation fulcrum portion on the lever is rotatably pivoted on the first connector, and a mounting position of the lever is arranged substantially in parallel in a width direction of the first connector, wherein a positional relation among the rotation fulcrum portion, the application point portion and the operation portion is set so that the fitting force is generated by the operation force in a drawing direction applied to the operation portion, and wherein the operation force in the drawing direction applied to the operation portion is regularly fitting the first connector to the second connector, after the first connector and the second connector are fixed to each other until a lever operation starting position.

In this lever fitting type connector, on the basis of the positional relation among the rotation fulcrum portion, the application point portion and the operation portion of the lever, the fitting force is generated between both of the connectors by applying the operation force in the drawing direction to the operation portion. Accordingly, it is possible to arrange the initial mounting position of the lever substantially in parallel to the width direction of the first connector. Further, at a time of regularly fitting both of the connectors, it is possible to generate the fitting force as far as an operation space exists in the drawing direction of the lever. Accordingly, since the lever is arranged in parallel to the width direction of the first connector at the initial mounting position, it is possible to reduce the protrusion of the lever from the first connector, or it is possible to prevent the protrusion of the lever from the first connector. Therefore, the first connector can be arranged compact as a whole in a state of mounting the lever. Further, when arranging the wire harness connected to the first connector, since the first connector is made compact, it is possible to reduce the space for arranging the wire. At this time, since no lever is provided in the second connector, a compact structure is obtained. Accordingly, it is possible to make the space for arranging the wire harness small.

The second aspect of the present invention provides a lever fitting type connector according to the first aspect of the present invention, wherein the lever fitting type connector further comprising: a breakaway mechanism provided between the lever and the first connector is freely breaking away the lever from a portion between the first connector and the second connector, in a state that the lever is completely fitting the first connector to the second connector.

In this lever fitting type connector, in the state that the lever is rotated to the completely fitting position between both of the connectors by operating the operation portion of the lever in the drawing direction, the breakaway mechanism is made such as to take out the lever from the portion between both of the connectors. Accordingly, when the lever becomes of no use due to the regularly fitting between both of the connectors, it is possible to take out the lever from the portion between both of the connectors.

The third aspect of the present invention provides a lever fitting type connector according to the second aspect of the present invention, wherein the breakaway mechanism comprising: a first groove portion continuously extending in a breakaway direction of the lever from an engagement portion of the rotation fulcrum portion, and freely moving the rotation fulcrum portion outward from the first connector and the second connector; a guide projection provided in the lever at a predetermined distance from the rotation fulcrum portion; and a second groove portion movably engaging the guide projection, and having a trailing end connected to the first groove portion, wherein the second groove portion is formed to a circular arc shape around the rotation fulcrum portion, and is taking the guide projection into the first groove portion at the completely fitting position of the lever.

In this lever fitting type connector, when rotating the lever around the rotation fulcrum portion so as to fit both of the connectors, the guide projection moves in a state of being engaged with the second groove portion. Hence, without the rotation fulcrum portion being moved, the lever rotates around the inherent engagement portion. Accordingly, it is possible to smoothly execute the rotational operation. Further, when the lever rotates to the completely fitting position, the guide projection is taken in the first groove portion, and both of the rotation fulcrum portion and the guide projection are arranged within the first groove portion. In this state, by moving the lever in a direction that the first groove portion extends, the rotation fulcrum portion and the guide projection move within the first groove portion and finally break away from the first groove portion. Accordingly, it is possible to take out the lever from both of the connectors, and to separate the lever from both of the connectors.

The fourth aspect of the present invention provides a lever fitting type connector comprising: a first connector; a second connector fitted to the first connector; and a lever interposed between the first connector and the second connector, having a rotation fulcrum portion, an application point portion and an operation portion, and converting an operation force applied to the operation portion into a fitting force between the first connector and the second connector, and having a flat plate shape, wherein the rotation fulcrum portion on the lever is rotatably pivoted on the first connector, and a mounting position of the lever is arranged substantially in parallel in a width direction of the first connector, wherein a positional relation among the rotation fulcrum portion, the application point portion and the operation portion is set so that the fitting force is generated by the operation force in a drawing direction applied to the operation portion, and wherein the operation force in the drawing direction applied to the operation portion is regularly fitting the first connector to the second connector, after the first connector and the second connector are fixed to each other until a lever operation starting position.

The fifth aspect of the present invention provides a lever fitting type connector according to the fourth aspect of the present invention, wherein the lever fitting type connector further comprising: a breakaway mechanism provided between the lever and the first connector is freely breaking away the lever from a portion between the first connector and the second connector, in a state that the lever is completely fitting the first connector to the second connector.

The sixth aspect of the present invention provides a lever fitting type connector according to the fifth aspect of the present invention, wherein the breakaway mechanism comprising: a first groove portion continuously extending in a breakaway direction of the lever from an engagement portion of the rotation fulcrum portion, and freely moving the rotation fulcrum portion outward from the first connector and the second connector; a guide projection provided in the lever at a predetermined distance from the rotation fulcrum portion; and a second groove portion movably engaging the guide projection, and having a trailing end connected to the first groove portion, wherein the second groove portion is formed to a circular arc shape around the rotation fulcrum portion, and taking the guide projection into the first groove portion at the completely fitting position of the lever.

BRIEF DESCRIPTION OF THE DRAWINGS

The invention will now be described with reference to the accompanying drawings wherein

FIG. 7B is an enlarged cross sectional view of the main portion in a regularly fitting state;

DETAILED DESCRIPTION OF THE PREFERRED EMBODIMENT

Figure 1:
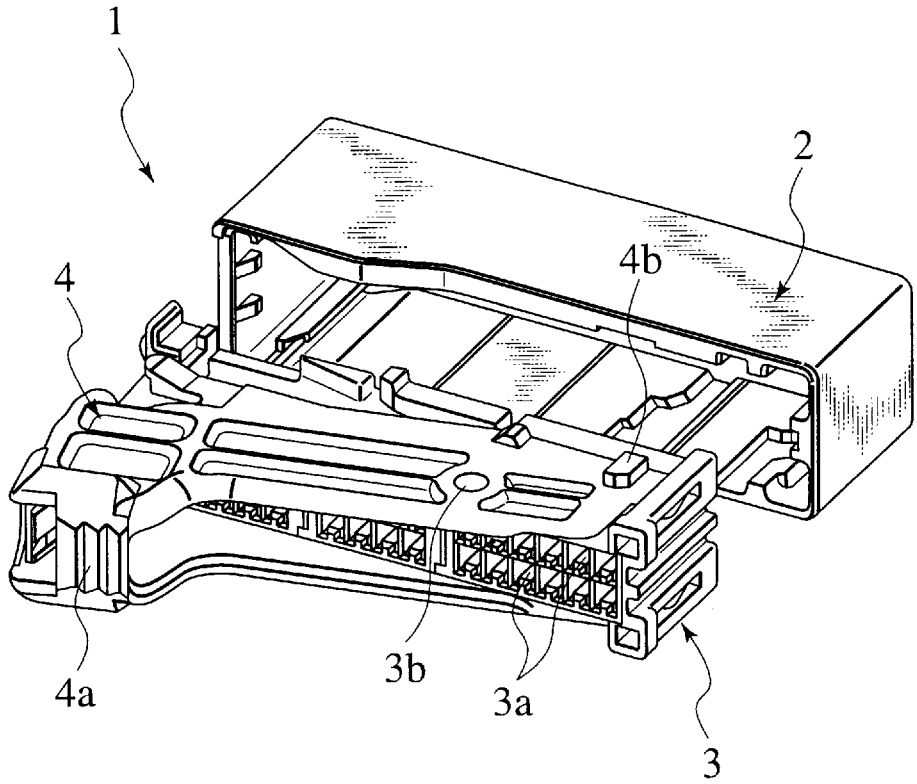
FIG. 1 shows a perspective view a state of separating female and male connectors in a proposed lever fitting type connector.
Figure 2:
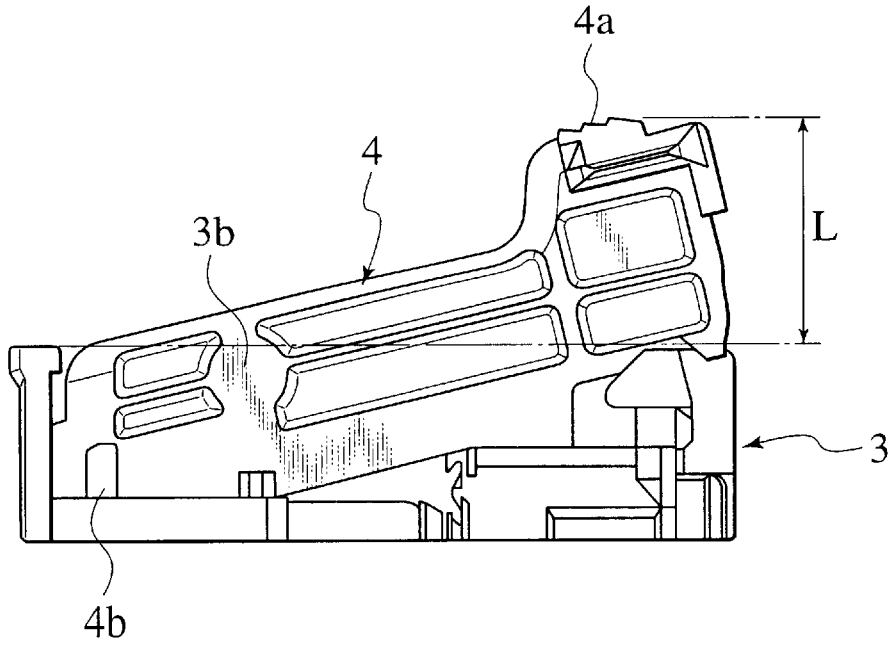
FIG. 2 shows a plan view of a state that a lever is mounted to the male connector in the proposed lever fitting type connector.

Embodiments of the present invention will be explained below with reference to the drawings, wherein like numbers are designated by like reference characters.

Figure 3:
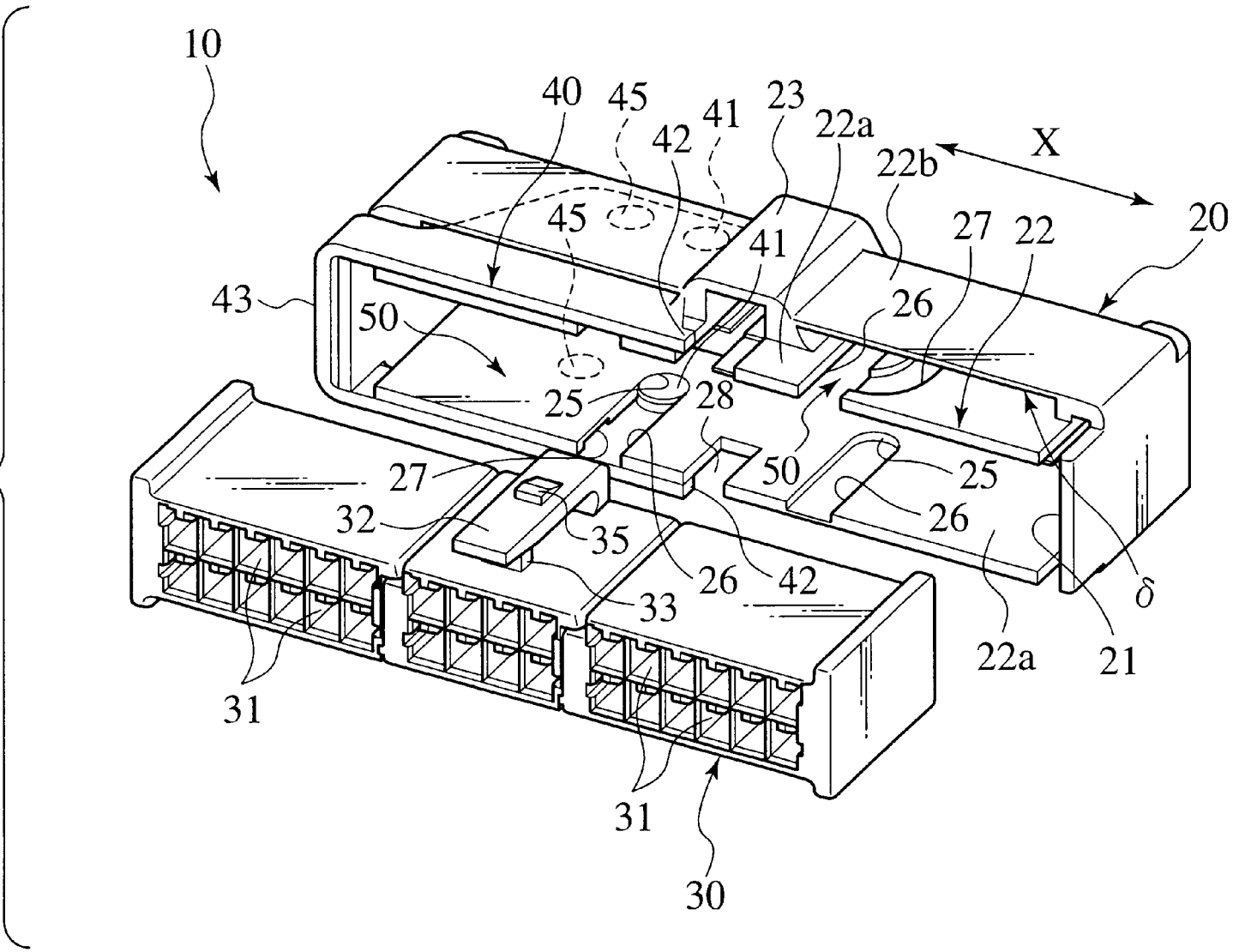
FIG. 3 shows a perspective view of a state that both connectors are separated, showing an embodiment of a lever fitting type connector according to the present invention.

As shown in FIG. 3, a lever fitting type connector 10 generally includes a synthetic resin female connector 20 corresponding to one of connectors fitted to each other, a synthetic resin male connector 30 corresponding to another connector, a synthetic resin lever 40 interposed between the female connector 20 and the male connector 30, provided with a rotation fulcrum portion 41 forming a fulcrum of rotation (rotary motion), and an application point portion 42 forming a application point and an operation portion 43 forming a point of force, and converting a rotating force into a fitting force between both of the connectors 20 and 30.

As shown in FIG. 3, the female connector 20 is constituted as a hollow case having a rectangular cross sectional shape. A front side in the drawing constitutes a frontage 21 for inserting the male connector 30, and upper and lower opposing walls of the frontage 21 constitute a lever-mounting portion 22. The lever mounting portion 22 is constructed as a double-wall structure by inner and outer walls 22*a* and 22*b*, and a gap δ substantially having a thickness of the lever 40 is formed between the inner and outer walls 22*a* and 22*b*. A lock receiving portion 23 extending in a fitting direction of the male connector 30 is protruded in an outer side of a center portion in the outer wall 22*b*.

Figure 6:
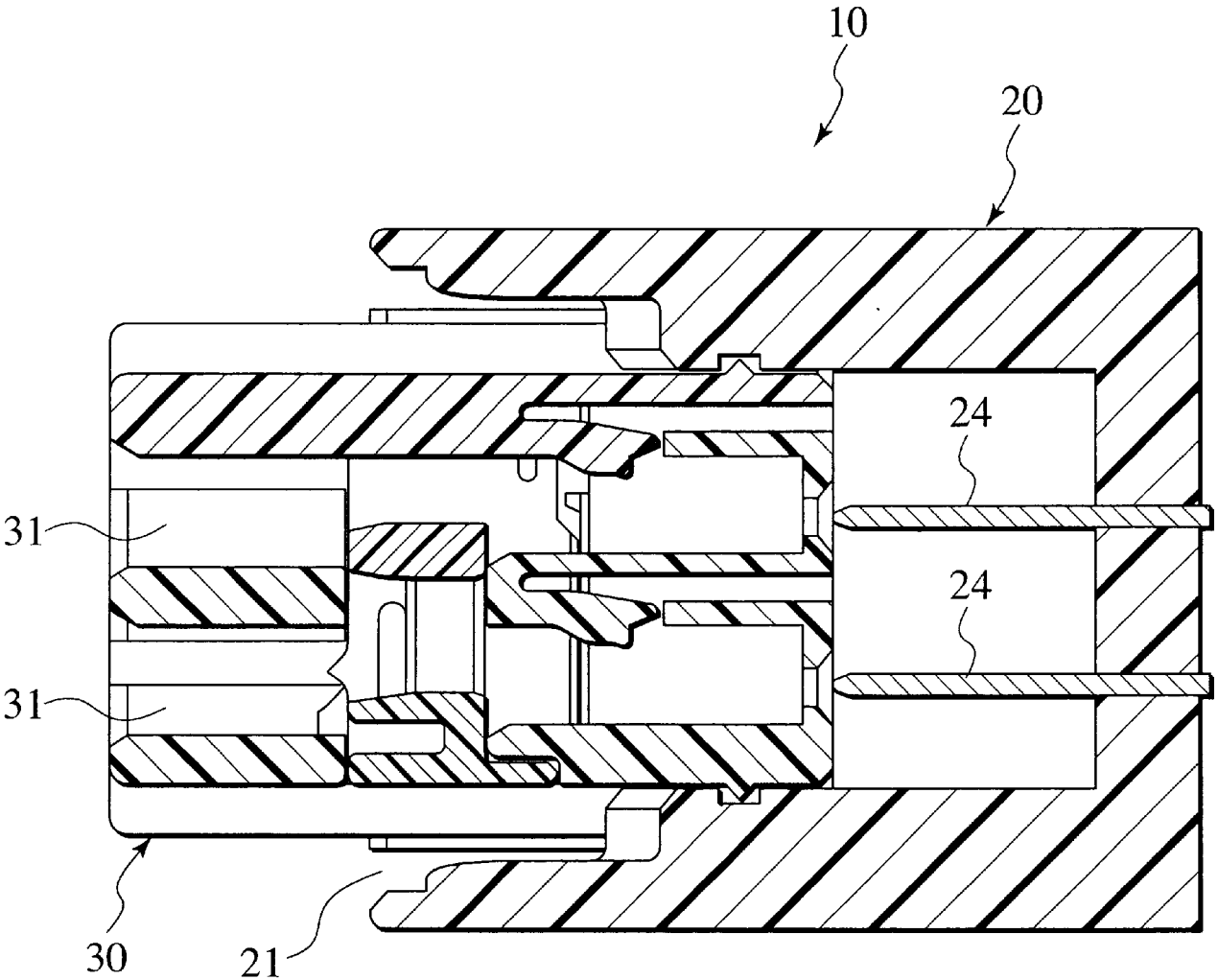
FIG. 6 shows a cross sectional view of a temporarily fitting state of both of the connectors, showing an embodiment of the lever fitting type connector according to the present invention.

As shown in FIG. 3, the male connector 30 is formed in a rectangular parallelepiped shape substantially closely fitted to an inner side of the female connector 20. A plurality of terminal receiving chambers 31 receiving female terminals connected to a edge (not shown) of respective electric wires in the wire harness are formed rightward and leftward in an inner portion, and the terminal receiving chambers 31 is arranged in upper and lower two stages in the male connector 30. At this time, the wire harness is arranged in a front side in the drawing. In this case, a plurality of male terminals 24 are protruded in a back side in a inner portion of the female connector 20 respectively in correspondence to the respective terminal receiving chambers 31 (refer to FIG. 6). In this case, in a state that the female connector 20 and the male connector 30 are regularly fitted to each other, the female terminals which are connected to a edge of respective electric wires in the wire harness in the male connector 30, are connected to the male terminals 24 of the female connector 20.

A flexible arm-shaped lock portion 32 fitted to a lock receiving portion 23, so as to prevent the male connector 30 from coming off, is provided in a center portion on an outer wall surface of the male connector 30. The lock portion 32 is provided with a connection portion 32*a* for the female connector 20 in a fitting side. Also, the lock portion 32 is protruded in a cantilever manner, so that an opposite side becomes a free end portion 32*b*. Therefore, a snapping force is applied to the free end portion 32*b* (refer to FIG. 7).

An engagement projection 33, which is positioned in a lower side of a middle portion in the lock portion 32 and engaging the application point portion 42 of the lever 40 therewith, is protruded on an upper wall surface of the male connector 30. Further, a rib (a guide portion) 34 guiding the application point portion 42 is integrally formed in an inner wall surface of the lock portion 32 in an inserting direction of the male connector 30. An inclined portion 34*a* is formed in the rib 34, so that a rib height is smoothly increased from the free end portion 32*b* to a position corresponding to the engagement projection 33.

A lock hook 35 is protruded on an outer surface of the lock portion 32. Further, a hook receiving recess portion 36 receiving the lock hook 35 is formed on an inner surface of the lock-receiving portion 23. The lock hook 35 is engaged with the hook receiving recess portion 36 in an inserting manner so as to be in a lock state. Hence, the loch state prevents the female connector 20 and the male connector 30 from coming off.

Figure 7A:
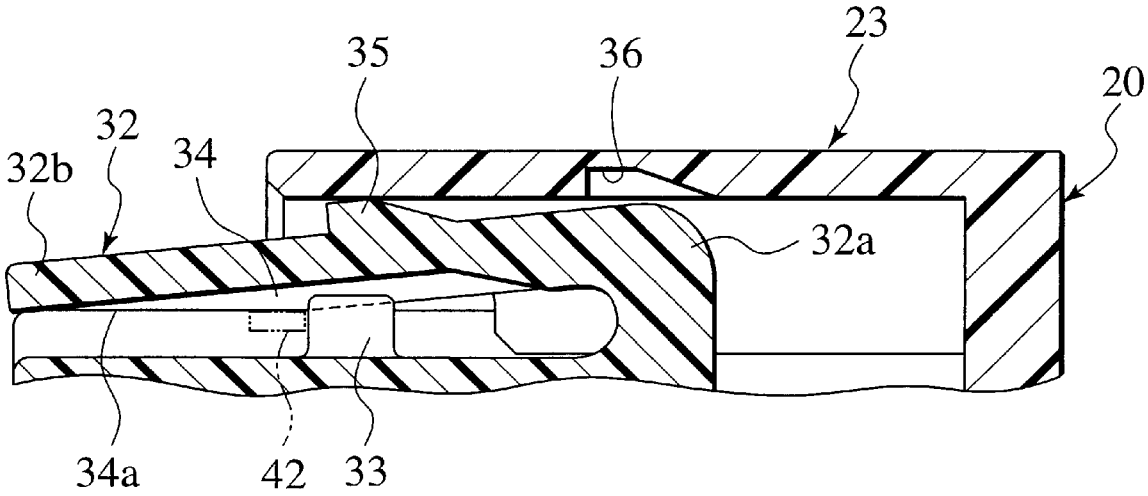
FIGS. 7A and 7B show an engagement relation of lock portions in both of the connectors, showing an embodiment of the lever fitting type connector according to the present invention, that FIG. 7A is an enlarged cross sectional view of a main portion in a temporarily fitting state.

The lock portion 32 is constituted such that in a temporarily fitting state between the female connector 20 and the male connector 30, the lock hook 35 is pressed to an inner side of the lock receiving portion 23 (refer to FIG. 7A). Further the rib 34 and the front-end portion of the engagement projection 33 are overlapped with each other by bending the lock portion 32 downward. In the regularly fitting state between the female and male connectors 20 and 30, the lock hook 35 engages with the hook receiving recess portion 36. Further, the lock portion 32 returns upward due to an elastic force, and a predetermined gap is formed between the rib 34 and the engagement projection 33 (refer to FIG. 7B).

Figure 4:
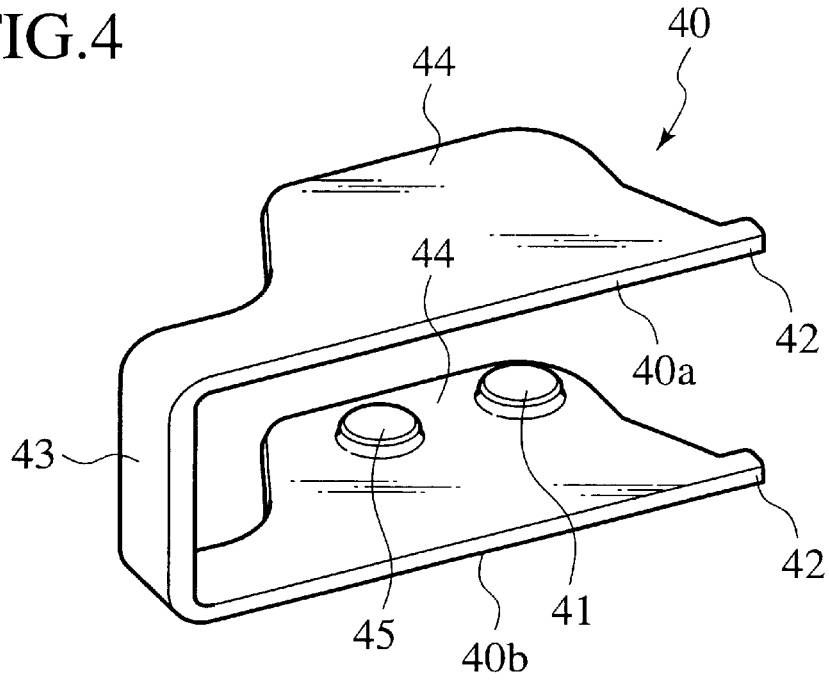
FIG. 4 shows an enlarged perspective view of a lever, showing an embodiment of the lever fitting type connector according to the present invention.

The lever 40 is formed in a U shape (refer to FIG. 4). Cylindrical projection-shaped rotation fulcrum portions 41 are inward protruded in wide portions 44 formed in both of opposing side portions 40*a* and 40*b*. A bent portion of the lever 40 forms an operation portion 43, and front-end portions of both side portions 40*a* and 40*b* form the application point portions 42. In the wide portions 44 of the lever 40, cylindrical guide projections 45 are protruded at positions of a predetermined distance L apart from the rotation fulcrum portion 41 to a side of the application point portion 42.

The lever 40 is mounted astride both of upper and lower sides of the male connector 30, and is inserting both side portions 40*a* and 40*b* to the gap δ of the lever mounting portion 22 in the female connector 20. Further, the lever 40 engages the rotation fulcrum portion 41 with the engagement portion 25 formed in the female connector 20.

As shown in FIG. 3, in a state that the female and male connectors 20 and 30 are separated, an initial mounting position of the lever 40 is arranged substantially in parallel to a width direction X of the female connector 20. A positional relation among the rotation fulcrum portion 41, the application point portion 42 and the operation portion 43 is set so as to generate the fitting force on the basis of the operation force in the drawing direction (a front side in the drawing) applied to the operation portion 43. That is, the rotation fulcrum portions 41 are arranged in the center portion in a longitudinal direction of the lever 40 with respect to the operation portion 43, and the application point portions 42 are arranged in the front end portions of both ends of the lever 40.

Figure 8A:
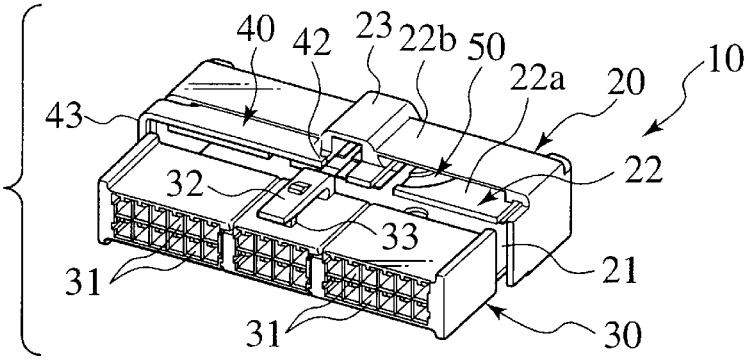
FIGS. 8A to 8E show an embodiment of the lever fitting type connector according to the present invention, that from 8A to 8E are perspective views sequentially showing fitting steps of both of the connectors.
Figure 8B:
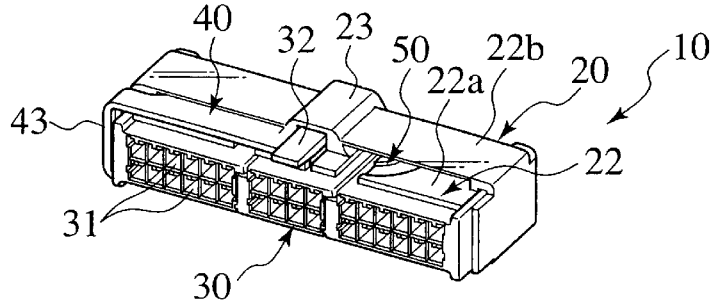
Figure 8C:
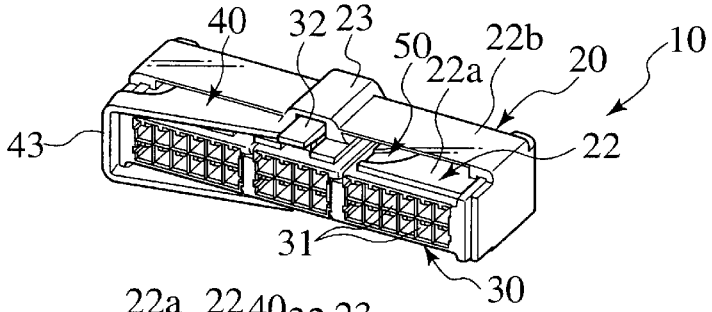
Figure 8D:
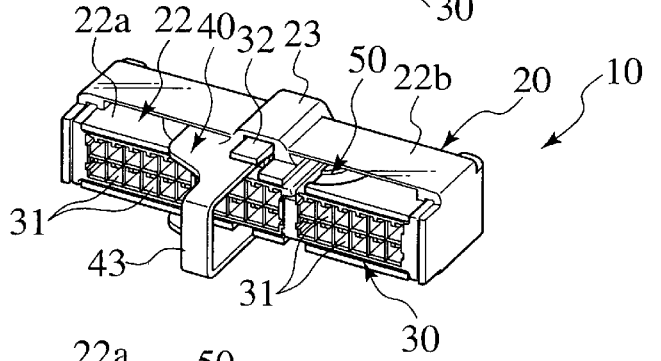
Figure 9A:
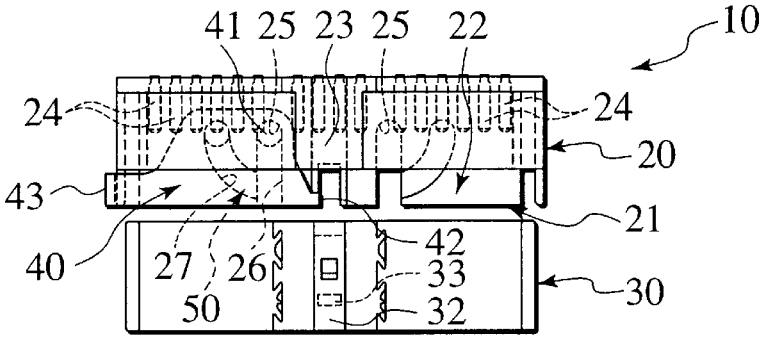
FIGS. 9A to 9E show an embodiment of the lever fitting type connector according to the present invention, that from 9A to 9E are plan views sequentially showing fitting steps of both of the connectors.
Figure 9B:
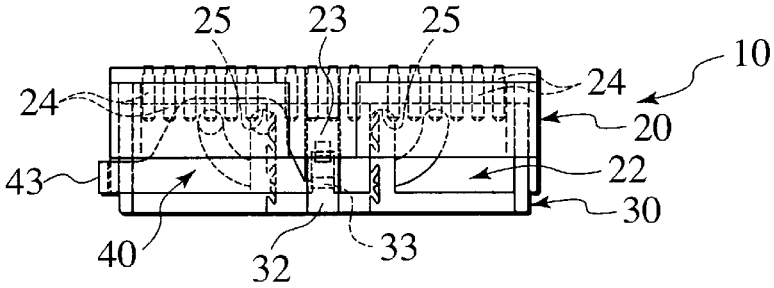

The female and male connectors 20 and 30 are inserted to each other from a relatively opposing position shown in FIGS. 8A and 9A to a temporarily fitting position of the lever 40 as shown in FIGS. 8B and 9B, that is, a lever operation starting position. Thereafter, the operation force in the drawing direction is applied to the operation portion 43 (refer to FIGS. 8C and 9C), and the female and male connectors 20 and 30 are regularly fitted (refer to FIGS. 8D and 9D).

Figure 8E:
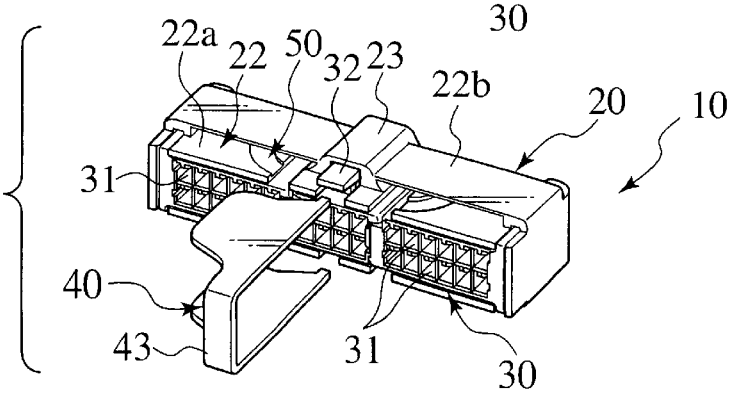

A breakaway mechanism 50 of the lever 40 is provided between the lever 40 and the male connector 30. In a state that the female and male connectors 20 and 30 are regularly fitted, that is, in a state that the lever 40 is set at a completely fitting position (refer to FIGS. 8D and 9D), the breakaway mechanism 50 freely breaks away the lever 40 from the portion between the female and male connectors 20 and 30 (refer to FIGS. 8E and 9E).

Figure 5:
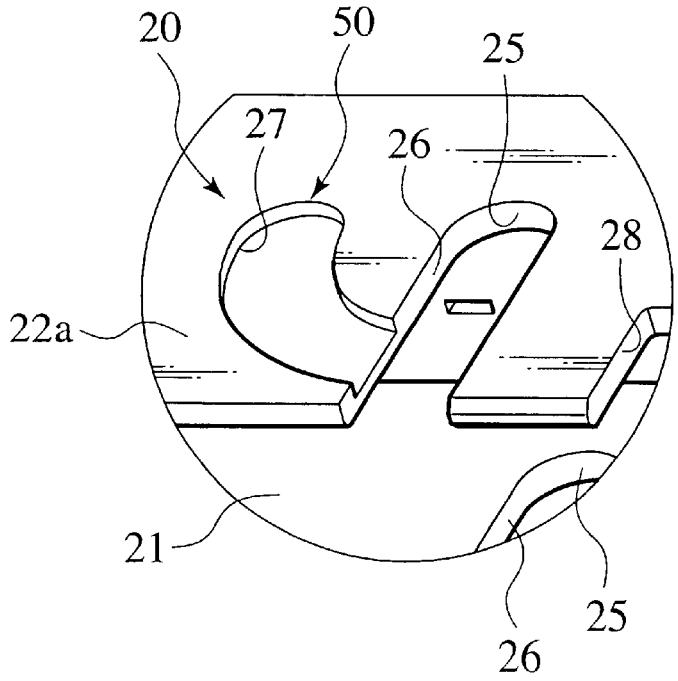
FIG. 5 shows an enlarged perspective view of a main portion of a breakaway mechanism, showing an embodiment of the lever fitting type connector according to the present invention.

As shown in FIGS. 3 and 5, the breakaway mechanism 50 is constituted by a guide projection 45 formed in the lever 40, a first groove portion 26 formed in an inner wall 22*a* of the lever mounting portion 22, and a second groove portion 27. The first groove portion 26 is formed in a groove shape, and continuously extends from the engagement portion 25 of the rotation fulcrum portion 41 toward a breakaway direction of the lever 40. That is, the first groove portion 26 extends to be open to the side of the frontage 21 of the female connector 20. Further, the rotation fulcrum portion 41 is made movable to an outer direction of the female and male connectors 20 and 30.

The second groove portion 27 is formed on an outer surface of the inner wall 22*a* of the lever mounting portion 22 so as to be formed in a groove shape. Thereby, the second groove portion 27 is movably engaging the guide projection 45. Further, an end edge of the second groove portion 27 is formed so as to be connected to the first groove portion 26, and the second groove portion 27 is formed to a circular arc shape around the rotation fulcrum portion 41. It is formed so as to take the guide projection 45 in the first groove portion 26 in the completely fitting position (the regularly fitting state) of the lever 40.

In the inner wall 22*a* of the lever-mounting portion 22, a groove portion 28 is formed in a center portion in the width direction X that the lock portion 32 is formed. The first groove portion 26 and the second groove portion 27 are formed symmetrically in the width direction X with respect to the groove portion 28 in the center portion. Further, it is possible to reversibly mount by reversing the lever 40 in the width direction X.

A description will be given below a fitting procedure of the lever fitting type connector 10 having the structure mentioned above.

As shown in FIG. 1, in a state before the female and male connectors 20 and 30 are fitted to each other, the rotation fulcrum portion 41 of the lever 40 is fitted to the engagement portion 25 of the female connector 20. Then, in a state that the guide projection 45 is engaged with a starting end portion (a back portion) of the second groove portion 27, an initial mounting of the guide projection 45 is executed in a state that the guide projection 45 is engaged with a starting end portion (a back portion) of the second groove portion 27. In this initially mounting state, the lever 40 is in parallel to the width direction X of the frontage 21.

Figure 7B:
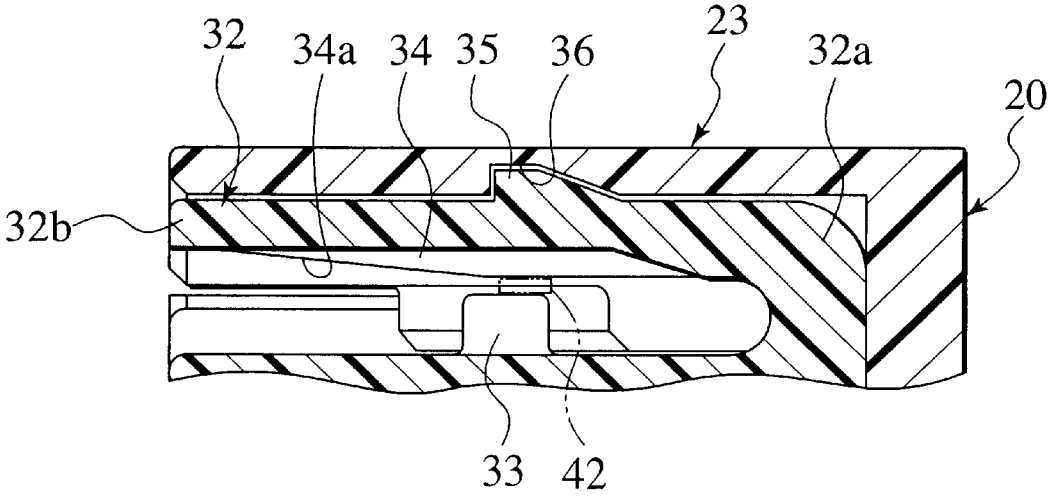
Figure 9C:
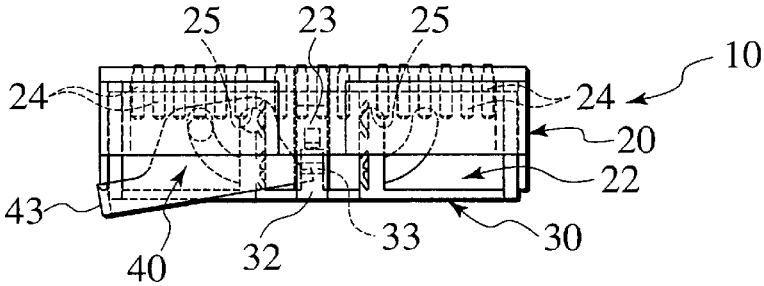

In this state, the male connector 30 is inserted from the frontage 21 of the female connector 20 (refer to FIGS. 8C and 9C). Then the lock portion 32 of the male connector 30 is fitted to the lock receiving portion 23 of the female connector 20, and the rib 34 on the inner surface of the lock portion 32 is in a state of being overlapped with the engagement projection 33 (a temporarily engagement state) (refer to FIG. 7).

As shown in FIGS. 8C and 9C, when applying the operation force in the drawing direction to the operation portion 43 of the lever 40 so as to rotate the lever 40 around the rotation fulcrum portion 41, the application point portion 42 of the front end portion becomes in a state of being engaged with the engagement projection 33. At this time, since the rib 34 of the lock portion 32 is overlapped with the front end portion of the engagement projection 33, the application point portion 42 is securely engaged without getting over the engagement projection 33.

In the state that the application point portion 42 and the engagement projection 33 are engaged as mentioned above, when further rotating the lever 40, the lever 40 servo assists the operation force to apply the force to the engagement projection 33. The operation force is applied to the operation portion 43 with setting the rotation fulcrum portion 41 to a point of support and setting the application point portion 42 to a point of application. The operation force at this time generates the fitting force between the female and male connectors 20 and 30, thereby pressing the male connector into the female connector 20. Since the guide projection 45 moves in a state of being engaged with the second groove portion 27, it is possible to prevent the rotation fulcrum portion 41 from moving within the first groove portion 26 by the engagement portion between the guide projection 45 and the second groove portion 27. Also it is possible to smoothly execute the rotational operation of the lever 40.

Figure 9D:
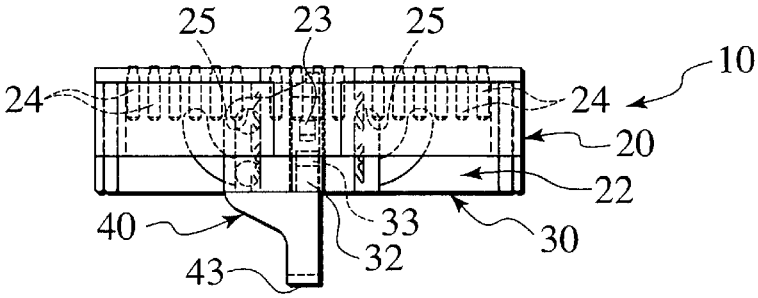
Figure 9E:
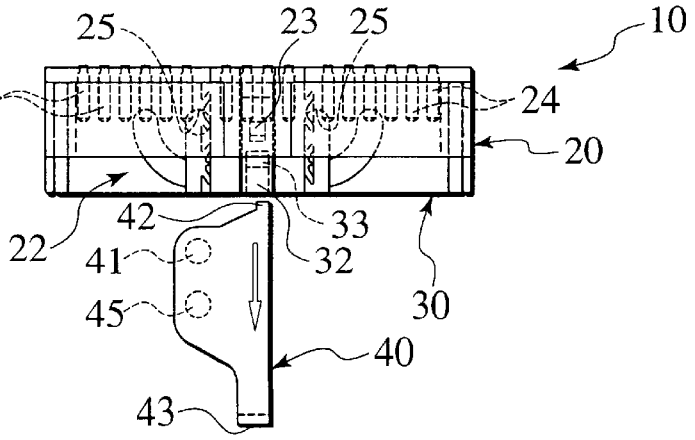

As shown in FIG. 8D and FIG. 9D, when the lever 40 rotates to the completely fitting position, and the female and male connectors 20 and 30 become in the regularly fitting state, the lock hook 35 is inserted to the hook receiving recess portion 36 so as to be engaged (refer to FIG. 7B). Then, a gap at a degree of passing the application point portion 42 therethrough is formed between the rib 34 and the engagement projection 33. Accordingly, when the lever 40 is further rotated from the regularly fitting state, the application point portion 42 gets over the engagement projection 33. When the guide projection 45 enters into the first groove portion 26 from the end edge of the second groove portion 27 due to the further rotation of the lever 40, both of the rotation fulcrum portion 41 and the guide projection 45 are positioned within the first groove portion 26. In this state, by outward drawing the lever 40, the rotation fulcrum portion 41 and the guide projection 45 move in the first groove portion 26, and the lever 40 is breaked away. Whereby it is possible to take out the lever 40 from the portion between the female and male connectors 20 and 30 so as to separate the lever 40 from the connector 10 (refer to FIG. 8 and FIG. 9).

In the lever fitting type connector 10, the lever 40 is arranged in parallel to the width direction X of the female connector 20 in the initially mounting state. The structure is made such that the fitting force is generated between the female and male connectors 20 and 30 by applying the operation force in the drawing direction to the operation portion 43 in the temporarily fitting state of the female and male connectors 20 and 30. Accordingly, at a time of the regularly fitting the female and male connectors 20 and 30, it is possible to generate the fitting force if the operation space exists in the drawing direction of the lever 40.

In the state that the female and male connectors 20 and 30 are separated, the initially mounting position of the lever 40 is arranged in parallel to the width direction X of the female connector 20. Accordingly, since it is possible to reduce a protruding amount of the lever 40 from the female connector 20, or it is possible to prevent the lever 40 from protruding, the female connector 20 can be arranged compact as a whole in a state of mounting the lever 40. Accordingly, when arranging the wire harness (not shown) connected to the female connector 20, the female connector 20 can be made compact, and it is possible to make the wire arranging space small.

Since the lever 40 is mounted to the female connector 20, the lever 40 is not provided in the male connector 30 side, so that a compact structure of the lever fitting type connector 10 is achieved. Accordingly, it is possible to make the space for arranging the wire harness connected to the male connector 30 smaller. Therefore, the lever fitting type connector 10 has advantages that it becomes easy to execute the operation of arranging the wire harness, and it is easier to secure the space for arranging the wire harness.

In the state that the lever 40 is rotated to the completely fitting position, it is possible to take out the lever 40 from the portion between the female and male connectors 20 and 30 by the breakaway mechanism 50. Accordingly, it is possible to take out the lever 40, which becomes of no use due to the regularly fitting of the female and male connectors 20 and 30. The taken-out lever 40 can be mounted to another new female connector 20, whereby it is possible to recycle the lever 40. Accordingly, it is possible to achieve an environmental protection as well as an effective utilization of resource. The lever 40 is removed, whereby a weight corresponding to the lever 40 can be reduced, so that in the case of being used for wiring in the vehicle that a lot of connectors are employed, it is possible to contribute to reduction of the vehicle body weight.

In the present embodiment, there is disclosed the case that the lever 40 is mounted to the female connector 20 side. However, it is possible to mount the lever to the male connector 30 side by changing the positional relation among the rotation fulcrum portion 41, the application point portion 42 and the operation portion 43.

In the present embodiment, the lever 40 is formed in the U shape, so as to be astride between both of upper and lower sides of the female connector 20, and the rotation fulcrum portion 41 and the application point portion 42 are provided on the U-shaped opposing surfaces of the lever 40. Further, these elements are engaged with the engagement portion 25 and the engagement projection 33 provided in both of upper and lower sides in the female and male connectors 20 and 30. However, the structure is not limited to this, the lever is formed in a simple flat plate shape, and the engagement portion 25 and the engagement projection 33 are provided only one side of the female and male connectors 20 and 30.

What is claimed is:

1. A lever fitting type connector, comprising a first connector;

a second connector fitted to the first connector;

a lever interposed between the first connector and the second connector, the lever having a rotation fulcrum portion, an application point portion and an operation portion and the lever being configured to convert an operation force applied to the operation portion into a fitting force between the first connector and the second connector; and a breakaway mechanism between the first connector and the second connector, the breakaway mechanism configured to allow the lever to freely breaking away from between the first connector and the second connector after the lever has completely fitted the first connector to the second connector;

wherein the lever pivots on the rotation fulcrum portion so as to rotate relative to the first connector, and the lever is initially mounted such that the lever is substantially parallel in a width direction to the first connector, wherein the rotation fulcrum portion, the application point portion and the operation portion are positioned in relation to each other such that when the operation force is applied to the operation portion in a drawing direction, the fining force generated by the operation force is in a same direction as the drawing direction, and wherein the operation force applied to the operation portion in the drawing direction regularly fits the first connector to the second connector, after the first connector and the second connector are temporarily fitted to each other in a lever operation starting position.

2. The lever fitting type connector of claim 1, wherein the breakaway mechanism comprises:

a first groove portion continuously extending in a breakaway direction of the lever from an engagement portion configured to engage the rotation fulcrum portion, and configured to freely move the rotation fulcrum portion outward from the first connector and the second connector;

a guide projection on the lever at a predetermined distance from the rotation fulcrum portion; and a second groove portion configured to movably engage the guide projection, and having a trailing end connected to the first groove portion, wherein the second groove portion has a circular arc shape around the rotation fulcrum portion, and configured to take the guide projection into the first groove portion when the lever has completely fitted the first connector to the second connector.

3. A lever fitting type connector, comprising:

a first connector;

a second connector fitted to the first connector;

a lever interposed between the first connector and the second connector, the lever having a rotation fulcrum portion, an application point portion and an operation portion, and the lever being configured to convert an operation force applied to the operation portion into a fitting force between the first connector and the second connector, and the lever having a flat plate shape; and a breakaway mechanism between the first connector and the second connector the breakaway mechanism configured to allow the lever to freely breaking away from between the first connector and the second connector after the lever has completely fitted the first connector to the second connector;

wherein the lever pivots on the rotation fulcrum portion so as to rotate relative to the first connector, and the lever is initially mounted such that the lever is substantially parallel in a width direction to the first connector, wherein the rotation fulcrum portion, the application point portion and the operation portion are positioned in relation to each other such that when the operation force is applied to the operation portion in a drawing direction, the fitting force generated by the operation force is in a same direction as the drawing direction, and wherein the operation force applied to the operation portion in the drawing direction regularly fits the first connector to the second connector, after the first connector and the second connector are temporarily fitted to each other in a lever operation starting position.

4. The lever fitting type connector of claim 3, wherein the breakaway mechanism comprises:

a first groove portion continuously extending in a breakaway direction of the lever from an engagement portion configured to engage the rotation fulcrum portion, and configured to freely move the rotation fulcrum portion outward from the first connector and the second connector a guide projection on the lever at a predetermined distance from the rotation fulcrum portion; and a second groove portion configured to movably engage the guide projection, and having a trailing end connected to the first groove portion, wherein the second groove portion has a circular arc shape around the rotation fulcrum portion, and configured to take the guide projection into the first groove portion when the lever has completely fitted the first connector to the second connector.

* * * * *

UNITED STATES PATENT AND TRADEMARK OFFICE

CERTIFICATE OF CORRECTION

PATENT NO. : 6,648,658 B2
DATED : November 18, 2003
INVENTOR(S) : Toshiaki Okabe and Tetsuya Yamashita It is certified that error appears in the above-identified patent and that said Letters Patent is hereby corrected as shown below:

Column 9,
Line 45, “comprising” should read -- comprising: --.
Line 51, “portion and the” should read -- portion, and the --.
Line 57, “breaking” should read -- break --.

Column 10,
Line 39, “connector the” should read -- connector, the --.
Line 40, “breaking” should read -- break --.
Lines 66-67, “second connector” should read -- second connector; --.

Signed and Sealed this

Fifteenth Day of June, 2004

JON W. DUDAS
*Acting Director of the United States Patent and Trademark Office*